US007414592B2

(12) United States Patent
Hsu et al.

(10) Patent No.: US 7,414,592 B2
(45) Date of Patent: Aug. 19, 2008

(54) ANTENNA APPARATUS

(75) Inventors: Kang-Neng Hsu, Hsinchu (TW); Chih-Ming Chen, Hsinchu (TW); Liang-Neng Lee, Hsinchu (TW)

(73) Assignee: Inpaq Technology Co., Ltd., Hsinchu (TW)

( * ) Notice: Subject to any disclaimer, the term of this patent is extended or adjusted under 35 U.S.C. 154(b) by 176 days.

(21) Appl. No.: 11/580,079

(22) Filed: Oct. 13, 2006

(65) Prior Publication Data

US 2008/0088512 A1 Apr. 17, 2008

(51) Int. Cl.
*H01Q 1/24* (2006.01)

(52) U.S. Cl. ..... 343/895; 343/702; 343/901

(58) Field of Classification Search ..... 343/702, 343/725, 727, 729, 895, 900, 901
See application file for complete search history.

(56) References Cited

U.S. PATENT DOCUMENTS 4,882,591 A * 11/1989 Galvin et al. ..... 343/715
5,587,695 A * 12/1996 Warmerdam ..... 336/84 R
5,914,697 A * 6/1999 Seki ..... 343/895
6,239,768 B1 * 5/2001 Oh et al. ..... 343/895
6,421,029 B1 * 7/2002 Tanabe ..... 343/895

* cited by examiner

*Primary Examiner*—Douglas W. Owens
*Assistant Examiner*—Chuc Tran
(74) *Attorney, Agent, or Firm*—Rosenberg, Klein & Lee

(57) ABSTRACT

An antenna apparatus includes a hollow column, a conductive cable, a first metal wire, a column structure, and a second metal wire. The conductive cable is received in the hollow column, and the conductive cable electrically contacts the hollow column via a second conductive wire layer thereof. One side of the first metal wire is electrically connected with a first conductive wire layer of the conductive cable. The column structure has a column body, a metal layer formed on the column body, at least one spiral groove formed on the metal layer for exposing a part of the column body, and two conductive covers respectively disposed on two sides of the column body. Moreover, one of the two conductive covers is electrically connected with the other side of the first metal wire. Furthermore, one side of the second metal wire is electrically connected with the other conductive cover.

10 Claims, 4 Drawing Sheets

ANTENNA APPARATUS

BACKGROUND OF THE INVENTION

1. Field of the Invention

The present invention relates to an antenna apparatus, and particularly relates to a metal layer with at least one spiral groove that is formed on the column body of the antenna apparatus.

2. Description of the Related Art

Due to the development of communication technology, a lot of electronic products that use wireless communication technology have been developed, such as cell phones, wireless Internet devices and personal digital assistants (PDAs), etc. Consumers demand that such wireless communication devices have consistently better and better features and appearance, as well as smaller dimensions so that they are easy to carry around.

For cell phones, the number of receiving frequencies has increased from an original single frequency, to two, to three, and now a fourth. The receiving-signal effect of wireless communication devices is an important index for evaluating wireless communication devices. The antenna apparatus is a key factor to determine the receiving-signal effect of wireless communication devices. Therefore, it is important to develop an antenna apparatus that receives signals effectively and also has a fresh fashionable appearance and a small size.

Referring to FIGS. 1 and 2, a known antenna apparatus A includes a hollow column 1*a*, a conductive cable 2*a*, a first copper wire 3*a*, a copper column 4*a*, a second copper wire 5*a*, and an external casing 6*a*.

The conductive cable 2*a* is received into the hollow column 1*a*, and the conductive cable 2*a* electrically contacts the hollow column 1*a*. Moreover, the first copper wire 3*a* electrically connects between the conductive cable 2*a* and the copper column 4*a*. In addition, the second copper wire 5*a* has a spring structure 50*a*, and the copper wire 5*a* is embedded on a top side of the copper column 4*a*. Furthermore, the external casing 6*a* entirely covers the hollow column 1*a*, the conductive cable 2*a*, the first copper wire 3*a*, the copper column 4*a*, and the second copper wire 5*a*. Finally, as shown in FIG. 2, the antenna apparatus A is installed on an AP (Access Point) P.

However, the spiral structure 50 of the second copper wire 5*a* often deforms during shipment. The deformation of the spiral coil affects the signal receiving ability and the quality of the antenna. Moreover, due to the structure of the antenna, the dimension of the antenna cannot be shrunk further. In addition, the known antenna apparatus has some defects such as its low frequency bandwidth is narrow.

SUMMARY OF THE INVENTION

One particular aspect of the present invention is to provide an antenna apparatus and a method for manufacturing the same. This invention forms a spiral metal layer on a column body. The antenna apparatus of the present invention can simplify the manufacturing process and enhance the yield rate.

Another particular aspect of the present invention is to provide an antenna apparatus and a method for manufacturing the same. It forms a column body by using a ceramic material. A metal layer is electroplated on the column body. Then, a spiral groove is formed on the metal layer. The structure of the antenna apparatus of the present invention is simple. Therefore, the cost is reduced.

A further particular aspect of the present invention is to provide an antenna apparatus and a method for manufacturing the same. This invention forms a spiral metal layer on a column body. By adjusting the pitch of the spiral groove, the spiral groove of the metal layer has a single pitch or a plurality of pitches. Therefore, the antenna apparatus of the present invention can be applied to a wireless communication device having a single frequency, and the manufacturing method for producing multiple pitches can be easily implemented.

Another particular aspect of the present invention is to provide an antenna apparatus and a method for manufacturing the same. This invention forms a spiral metal layer on a column body. Its structure is simple. The dimensions of the antenna can be shrunk according to demands. Therefore, the antenna apparatus of the present invention can be installed on the outside of the wireless communication device so that it is an external type antenna. Thereby, the antenna apparatus of the present invention can be installed on the wireless communication device using a variety of types to provide an excellent quality of receiving signal.

In order to achieve the above-mentioned aspects, the present invention provides an antenna apparatus, comprising a hollow column, a conductive cable, a first metal wire, a column structure, and a second metal wire. The conductive cable is received in the hollow column, and the conductive cable has a first conductive wire layer, a first insulating layer for covering the first conductive wire layer, a second conductive wire layer for covering the first insulating layer and electrically connecting with the hollow column. The first metal wire has one side electrically connected with the first conductive wire layer of the conductive cable. The column structure has a column body, a metal layer formed on the column body, at least one spiral groove formed on the metal layer for exposing one part of the column body, and two conductive covers respectively disposed on two sides of the column body, wherein one of the two conductive covers is electrically connected with the other side of the first metal wire. The second metal wire has one side electrically connected with the other conductive cover.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objects and advantages of the present invention will be more readily understood from the following detailed description when read in conjunction with the appended drawings, in which.

DETAILED DESCRIPTION OF THE PREFERRED EMBODIMENTS

Figure 1:
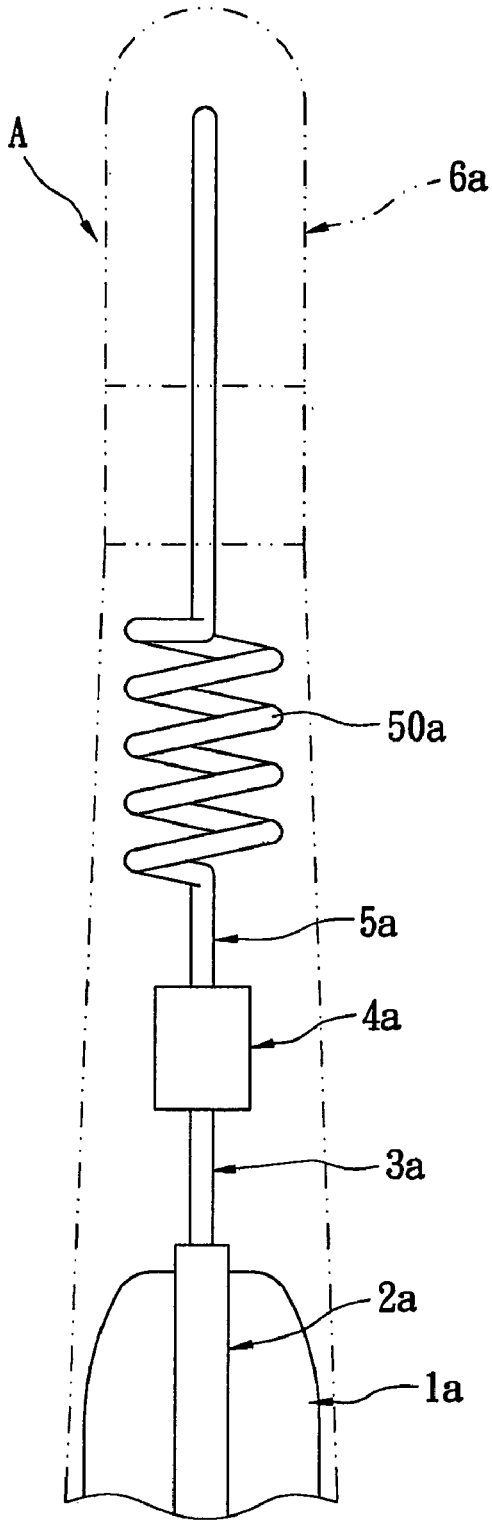
FIG. 1 PRIOR ART
FIG. 1 is a schematic view of an antenna apparatus of the prior art.
Figure 2:
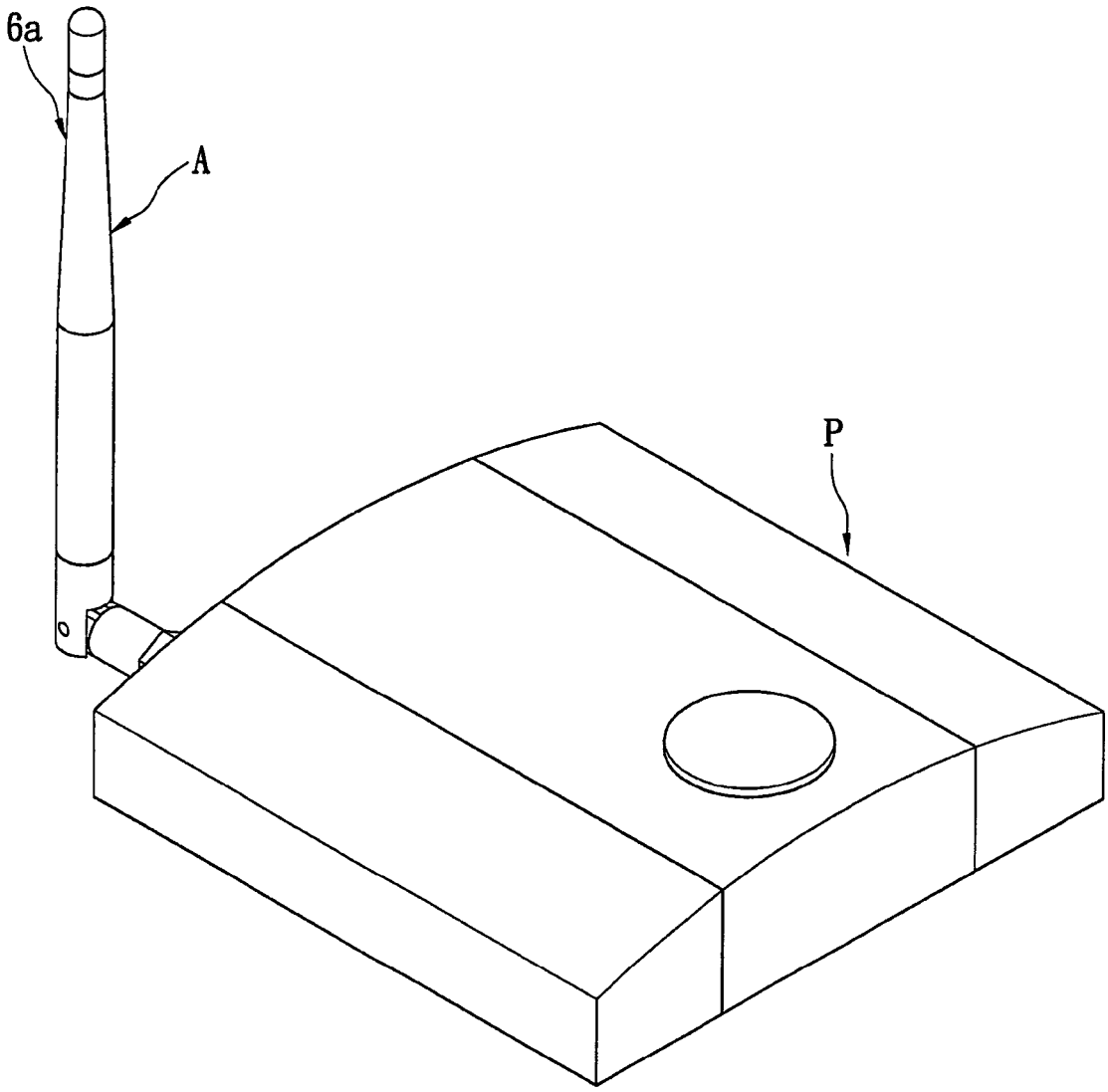
FIG. 2 PRIOR ART
FIG. 2 is a schematic view of an antenna apparatus applied to an AP (Access Point) according to the prior art.
Figure 3:
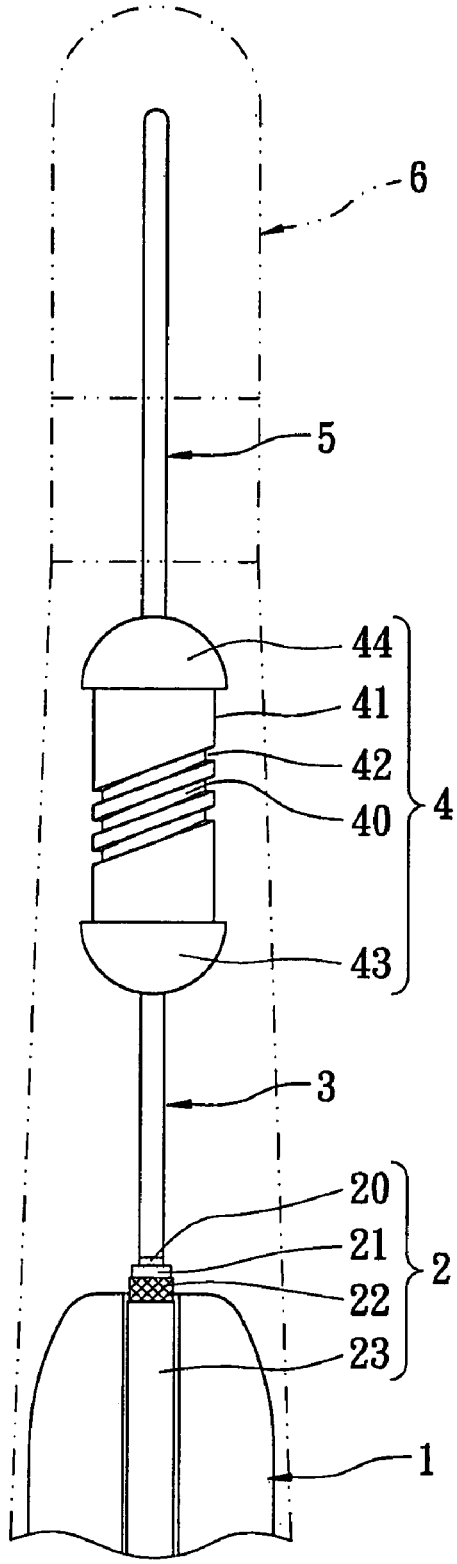
FIG. 3 is a schematic view of an antenna apparatus of the present invention.
Figure 4:
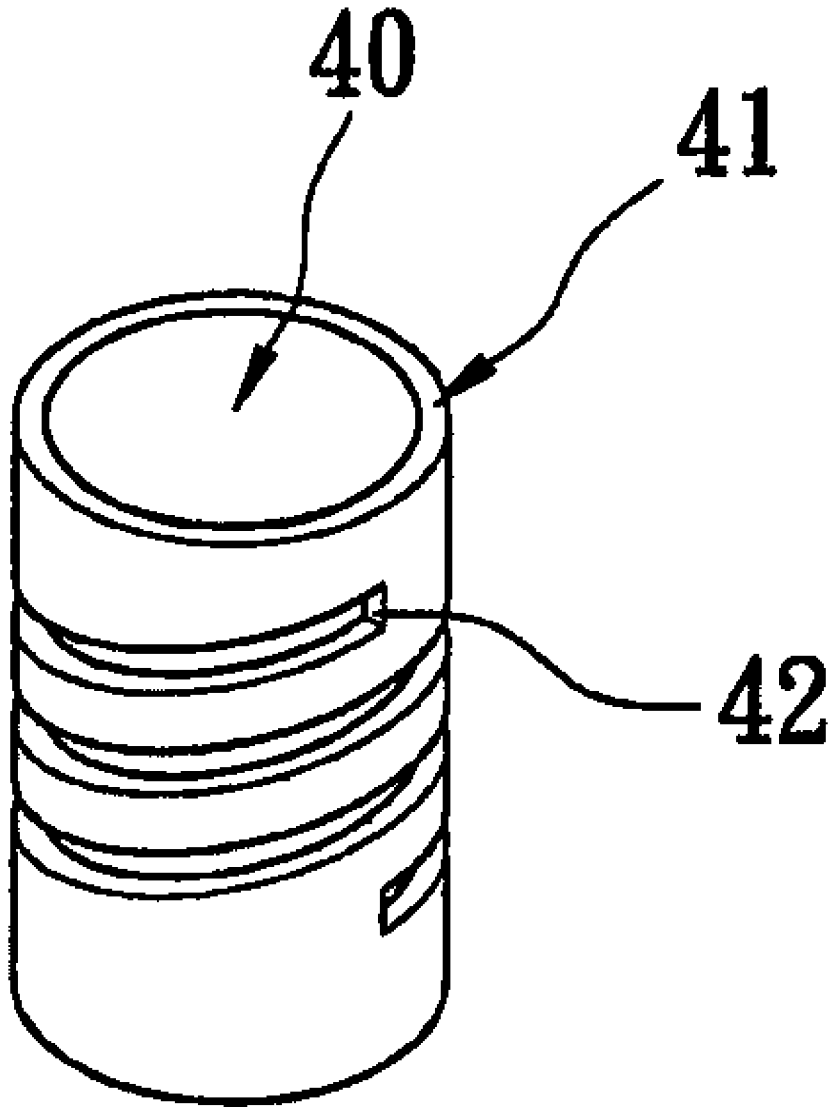
FIG. 4 is a perspective, schematic view of a column structure of an antenna apparatus of the present invention.

Referring to FIGS. 3 and 4, the present invention provides an antenna apparatus, comprising a hollow column 1, a conductive cable 2, a first metal wire 3, a column structure 4, and a second metal wire 5.

The hollow column 1 can be a hollow copper column. Moreover, the conductive cable 2 is received in the hollow column 1, and the conductive cable 2 has a first conductive wire layer 20, a first insulating layer 21 for covering the first conductive wire layer 20, a second conductive wire layer 22 for covering the first insulating layer 21 and electrically connecting with the hollow column 1.

Furthermore, the first metal wire 3 has one side electrically connected with the first conductive wire layer 20 of the conductive cable 2. In addition, the column structure 4 has a column body 40, a metal layer 41 formed on the column body 40, at least one spiral groove 42 formed on the metal layer 41 for exposing one part of the column body 40, and two conductive covers 43, 44 respectively disposed on two sides of the column body 40. One of the two conductive covers 43 is electrically connected with the other side of the first metal wire 3. Moreover, the second metal wire 5 has one side electrically connected with the other conductive cover 44. In addition, the antenna apparatus further comprises an external casing 6 for entirely covering the hollow column 1, the conductive cable 2, the first metal wire 3, the column structure 4, and the second metal wire 5. The antenna apparatus can further comprise another spiral groove (not shown) formed on the metal layer 41 for exposing another part of the column body 40.

Moreover, the column body 40 can be made of ceramic or any other materials that have the characteristics of insulation and being electroplated. The metal layer 41 is formed on a surface of the column body 40 and wraps all around the column body 40. In addition, the metal layer 41 is made of copper, gold, or other materials that have the characteristic of good electrical conductivity. Furthermore, the metal layer 41 is formed on the surface of the column body 40 by electroplating or any other coating methods. Moreover, the spiral groove 42 can have a single pitch or a plurality of different pitches. The conductive covers 43, 44 can be made of iron material. The first and the second metal wire layer 3, 5 can be made of copper material.

The antenna apparatus of the present invention has the following characteristics:

1. The antenna apparatus of the present invention forms a spiral metal layer on a column body to simplify the manufacturing process and increase the yield rate.

2. The structure of the antenna apparatus of the present invention is simple. Therefore, the cost is reduced.

3. By adjusting the pitch of the spiral groove, the antenna apparatus of the present invention can be applied to a single frequency wireless communication device.

4. The structure of the antenna apparatus of the present invention is simple and can be shrunk according to demands. Therefore, the antenna apparatus of the present invention can be used for an external antenna.

Although the present invention has been described with reference to the preferred best molds thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An antenna apparatus, comprising:

a hollow column;

a conductive cable received in the hollow column, wherein the conductive cable has a first conductive wire layer, a first insulating layer for covering the first conductive wire layer, a second conductive wire layer for covering the first insulating layer and electrically connecting with the hollow column;

a first metal wire having one side electrically connected with the first conductive wire layer of the conductive cable;

a column structure having a column body, a metal layer formed on the column body, at least one spiral groove formed on the metal layer for exposing one part of the column body, and two conductive covers respectively disposed on two sides of the column body, wherein one of the two conductive covers is electrically connected with the other side of the first metal wire; and a second metal wire having one side electrically connected with the other conductive cover.

2. The antenna apparatus as claimed in claim 1, wherein the hollow column is a hollow copper column.

3. The antenna apparatus as claimed in claim 1, wherein the column body is made of ceramic.

4. The antenna apparatus as claimed in claim 1, wherein the metal layer is made of copper or gold.

5. The antenna apparatus as claimed in claim 1, wherein the spiral groove has a single pitch.

6. The antenna apparatus as claimed in claim 1, wherein the spiral groove has a plurality of different pitches.

7. The antenna apparatus as claimed in claim 1, further comprising another spiral groove formed on the metal layer for exposing another part of the column body.

8. The antenna apparatus as claimed in claim 1, wherein the conductive covers are made of iron material.

9. The antenna apparatus as claimed in claim 1, wherein the first and the second metal wire layer are made of copper material.

10. The antenna apparatus as claimed in claim 1, further comprising an external casing for entirely covering the hollow column, the conductive cable, the first metal wire, the column structure and the second metal wire.

* * * * *